US010876402B2

(12) United States Patent
Sollami

(10) Patent No.: US 10,876,402 B2
(45) **Date of Patent: *Dec. 29, 2020**

(54) BIT TIP INSERT

(71) Applicant: The Sollami Company, Herrin, IL (US)

(72) Inventor: Phillip Sollami, Herrin, IL (US)

(73) Assignee: The Sollami Company, Herrin, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/960,728

(22) Filed: Apr. 24, 2018

(65) Prior Publication Data

US 2019/0234212 A1 Aug. 1, 2019

Related U.S. Application Data

(63) Continuation-in-part of application No. 15/923,051, filed on Mar. 16, 2018, and a continuation-in-part of (Continued)

(51) Int. Cl.
*E21C 35/183* (2006.01)
*E21B 10/573* (2006.01)

(Continued)

(52) U.S. Cl.
CPC ..... *E21C 35/1835* (2020.05); *E01C 23/088* (2013.01); *E21B 10/5673* (2013.01);

(Continued)

(58) Field of Classification Search
CPC ..... E21C 2035/1803; E21C 2035/1809; E21C 2035/1813; E21C 35/18; E21C 2035/1806;

(Continued)

(56) References Cited

U.S. PATENT DOCUMENTS 2,382,947 A 7/1944 Brozek
2,810,567 A 10/1957 Kirkham (Continued)

FOREIGN PATENT DOCUMENTS

DE 102004049710 4/2006
DE 102011079115 1/2013

(Continued)

*Primary Examiner* — David J Bagnell
*Assistant Examiner* — Michael A Goodwin
(74) *Attorney, Agent, or Firm* — Mercedes V. O'Connor; Rockman Videbeck & O'Connor

(57) ABSTRACT

An improved diamond coated bit tip insert for a unitary bit/holder, tool, and/or pick for road milling operations that includes a body including a tip and a base subjacent to the tip. The tip of the bit tip insert includes a substrate and an overlay on an outer surface of the substrate. The base of the bit tip insert includes a tapered sidewall or a cylindrical sidewall, the tapered sidewall providing a greater concentration of force applied at an interface of the overlay and the substrate of the tip during a high pressure high temperature (HPHT) process than when using the cylindrical sidewall and the high pressure, high temperature process.

2 Claims, 8 Drawing Sheets

Related U.S. Application Data application No. 14/676,364, filed on Apr. 1, 2015, now Pat. No. 9,976,418.

(60) Provisional application No. 61/974,064, filed on Apr. 2, 2014.

(51) Int. Cl.

| | |
|---|---|
| ***E21B 10/567*** | (2006.01) |
| ***E01C 23/088*** | (2006.01) |
| *E02F 9/28* | (2006.01) |
| *B28D 1/18* | (2006.01) |
| *E02F 5/08* | (2006.01) |
| *E01C 23/12* | (2006.01) |
| *E21C 27/24* | (2006.01) |

(52) U.S. Cl.

CPC ..... *E21B 10/5735* (2013.01); *E21C 35/183* (2013.01); *E21C 35/1837* (2020.05); *B28D 1/186* (2013.01); *E01C 23/127* (2013.01); *E02F 5/08* (2013.01); *E02F 9/2808* (2013.01); *E21C 27/24* (2013.01)

(58) Field of Classification Search

CPC ..... E21C 2035/1816; E21C 35/183; E21B 10/485; E21B 2010/561–565; E21B 10/46; E21B 10/48; E21B 10/50–56; E21B 10/567–58; E21B 2010/566

See application file for complete search history.

(56) References Cited

U.S. PATENT DOCUMENTS 3,342,531 A 9/1967 Krekeler
3,342,532 A 9/1967 Krekeler
3,397,012 A 8/1968 Krekeler
3,476,438 A 11/1969 Bower, Jr.
3,519,309 A 7/1970 Engle
3,833,264 A 9/1974 Elders
3,833,265 A 9/1974 Elders
3,865,437 A 2/1975 Crosby
4,084,856 A 4/1978 Emmerich
4,247,150 A 1/1981 Wrulich et al.
RE30,807 E 12/1981 Elders
4,310,939 A 1/1982 Iijima
4,453,775 A 6/1984 Clemmow
4,478,298 A 10/1984 Hake
4,489,986 A 12/1984 Dziak
4,525,178 A 6/1985 Hall
4,561,698 A 12/1985 Beebe
4,570,726 A 2/1986 Hall
4,604,106 A 8/1986 Hall
4,632,463 A 12/1986 Sterwerf, Jr.
4,694,918 A 9/1987 Hall
4,702,525 A 10/1987 Sollami
4,763,956 A 8/1988 Emmerich
4,811,801 A * 3/1989 Salesky ..... B22F 7/06 175/374
4,818,027 A 4/1989 Simon
4,821,819 A 4/1989 Whysong
4,844,550 A 7/1989 Beebe
4,915,455 A 4/1990 O'Niell
4,944,559 A 7/1990 Sionett
5,067,775 A 11/1991 D'Angelo
5,088,797 A 2/1992 O'Neill
5,098,167 A 3/1992 Latham
5,159,233 A 10/1992 Sponseller
5,161,627 A * 11/1992 Burkett ..... E21B 10/567 299/111
5,273,343 A 12/1993 Ojanen
5,287,937 A 2/1994 Sollami
5,302,005 A 4/1994 O'Neill
5,303,984 A 4/1994 Ojanen
5,352,079 A 10/1994 Croskey
5,370,448 A 12/1994 Sterwerf, Jr.
5,374,111 A 12/1994 Den Besten
5,415,462 A 5/1995 Massa
5,417,475 A 5/1995 Graham et al.
5,458,210 A 10/1995 Sollami
5,484,191 A 1/1996 Sollami
5,492,188 A 2/1996 Smith et al.
5,551,760 A 9/1996 Sollami
5,607,206 A 3/1997 Siddle
5,628,549 A 5/1997 Ritchey
5,720,528 A 2/1998 Ritchey
5,725,283 A 3/1998 O'Neill
5,823,632 A 10/1998 Burkett
5,924,501 A 7/1999 Tibbitts
5,931,542 A 8/1999 Britzke
5,934,854 A 8/1999 Krautkremer et al.
5,992,405 A 11/1999 Sollami
D420,013 S 2/2000 Warren
6,019,434 A 2/2000 Emmerich
6,102,486 A 8/2000 Briese
6,176,552 B1 1/2001 Topka, Jr.
6,196,340 B1 3/2001 Jensen et al.
6,199,451 B1 3/2001 Sollami
6,250,535 B1 6/2001 Sollami
6,331,035 B1 12/2001 Montgomery, Jr.
6,341,823 B1 1/2002 Sollami
6,357,832 B1 3/2002 Sollami
6,371,567 B1 4/2002 Sollami
6,382,733 B1 5/2002 Parrott
6,428,110 B1 8/2002 Ritchey et al.
6,508,516 B1 1/2003 Kammerer
D471,211 S 3/2003 Sollami
6,585,326 B2 7/2003 Sollami
6,685,273 B1 2/2004 Sollami
6,692,083 B2 2/2004 Latham
D488,170 S 4/2004 Sollami
6,733,087 B2 5/2004 Hall
6,739,327 B2 * 5/2004 Sollami ..... B28D 1/188 125/36
6,786,557 B2 9/2004 Montgomery
6,824,225 B2 11/2004 Stiffler
6,846,045 B2 1/2005 Sollami
6,854,810 B2 2/2005 Montgomery
6,866,343 B2 3/2005 Holl et al.
6,968,912 B2 11/2005 Sollami
6,994,404 B1 2/2006 Sollami
7,097,258 B2 8/2006 Sollami
7,118,181 B2 10/2006 Frear
7,150,505 B2 12/2006 Sollami
7,195,321 B1 3/2007 Sollami
7,210,744 B2 5/2007 Montgomery
7,229,136 B2 6/2007 Sollami
7,234,782 B2 6/2007 Stehney
D554,162 S 10/2007 Hall
7,320,505 B1 1/2008 Hall
7,338,135 B1 3/2008 Hall
7,347,292 B1 3/2008 Hall
D566,137 S 4/2008 Hall
7,353,893 B1 4/2008 Hall
7,384,105 B2 6/2008 Hall
7,396,086 B1 6/2008 Hall
7,401,862 B2 7/2008 Holl et al.
7,401,863 B1 7/2008 Hall
7,410,221 B2 8/2008 Hall
7,413,256 B2 8/2008 Hall
7,413,258 B2 8/2008 Hall
7,419,224 B2 9/2008 Hall
7,445,294 B2 11/2008 Hall
D581,952 S 12/2008 Hall
7,464,993 B2 12/2008 Hall
7,469,756 B2 12/2008 Hall
7,469,971 B2 12/2008 Hall
7,469,972 B2 12/2008 Hall
7,475,948 B2 1/2009 Hall
7,523,794 B2 4/2009 Hall
7,568,770 B2 8/2009 Hall
7,569,249 B2 8/2009 Hall
7,571,782 B2 8/2009 Hall
7,575,425 B2 8/2009 Hall

(56) References Cited

U.S. PATENT DOCUMENTS 7,588,102 B2 9/2009 Hall
7,594,703 B2 9/2009 Hall
7,600,544 B1 10/2009 Sollami
7,600,823 B2 10/2009 Hall
7,628,233 B1 12/2009 Hall
7,635,168 B2 12/2009 Hall
7,637,574 B2 12/2009 Hall
7,648,210 B2 1/2010 Hall
7,665,552 B2 2/2010 Hall
7,669,938 B2 3/2010 Hall
7,681,338 B2 3/2010 Hall
7,712,693 B2 5/2010 Hall
7,717,365 B2 5/2010 Hall
7,722,127 B2 5/2010 Hall
7,789,468 B2 9/2010 Sollami
7,832,808 B2 11/2010 Hall
7,883,155 B2 2/2011 Sollami
7,950,745 B2 5/2011 Sollami
7,963,617 B2 6/2011 Hall
7,992,944 B2 8/2011 Hall
7,992,945 B2 8/2011 Hall
7,997,660 B2 8/2011 Monyak et al.
7,997,661 B2 8/2011 Hall
8,007,049 B2 8/2011 Fader
8,007,051 B2 8/2011 Hall
8,029,068 B2 10/2011 Hall
8,033,615 B2 10/2011 Hall
8,033,616 B2 10/2011 Hall
8,038,223 B2 10/2011 Hall
8,061,784 B2 11/2011 Hall
8,109,349 B2 2/2012 Hall
8,118,371 B2 2/2012 Hall
8,136,887 B2 3/2012 Hall
8,201,892 B2 6/2012 Hall
8,215,420 B2 7/2012 Hall
8,292,372 B2 10/2012 Hall
8,414,085 B2 4/2013 Hall
8,449,039 B2 5/2013 Hall
8,485,609 B2 7/2013 Hall
8,500,209 B2 8/2013 Hall
8,540,320 B2 9/2013 Sollami
RE44,690 E 1/2014 Sollami
8,622,482 B2 1/2014 Sollami
8,622,483 B2 1/2014 Sollami
8,646,848 B2 2/2014 Hall
8,728,382 B2 5/2014 Hall
8,740,314 B2 6/2014 O'Neill
9,004,610 B2 4/2015 Erdmann et al.
9,028,008 B1 5/2015 Bookhamer
9,039,099 B2 5/2015 Sollami
9,316,061 B2 4/2016 Hall
9,518,464 B2 12/2016 Sollami
9,879,531 B2 1/2018 Sollami
9,909,416 B1 3/2018 Sollami
9,976,418 B2 5/2018 Sollami
9,988,903 B2 6/2018 Sollami
10,072,501 B2 9/2018 Sollami
10,105,870 B1 10/2018 Sollami
10,107,097 B1 10/2018 Sollami
10,107,098 B2 10/2018 Sollami
10,180,065 B1 1/2019 Sollami
10,260,342 B1 4/2019 Sollami
10,323,515 B1 6/2019 Sollami
10,337,324 B2 7/2019 Sollami
10,370,966 B1 8/2019 Sollami
10,385,689 B1 8/2019 Sollami
10,415,386 B1 9/2019 Sollami
10,502,056 B2 12/2019 Sollami
2002/0063467 A1 5/2002 Taitt
2002/0074850 A1 6/2002 Montgomery, Jr.
2002/0074851 A1 6/2002 Montgomery, Jr.
2002/0109395 A1 8/2002 Sollami
2002/0167216 A1 11/2002 Sollami
2002/0192025 A1 12/2002 Johnson
2003/0015907 A1 1/2003 Sollami
2003/0047985 A1 3/2003 Stiffler
2003/0052530 A1 3/2003 Sollami
2003/0122414 A1 7/2003 Sollami
2003/0193235 A1* 10/2003 Sollami ..... E21C 35/18 299/106
2003/0209366 A1 11/2003 McAlvain
2004/0004389 A1 1/2004 Latham
2004/0174065 A1 9/2004 Sollami
2005/0212345 A1 9/2005 Sleep et al.
2006/0071538 A1 4/2006 Sollami
2006/0186724 A1 8/2006 Stehney
2006/0261663 A1 11/2006 Sollami
2007/0013224 A1 1/2007 Stehney
2007/0040442 A1 2/2007 Weaver
2007/0052279 A1 3/2007 Sollami
2008/0035386 A1 2/2008 Hall et al.
2008/0036276 A1 2/2008 Hall et al.
2008/0036283 A1 2/2008 Hall et al.
2008/0100124 A1* 5/2008 Hall ..... E21B 10/5735 299/105
2008/0145686 A1 6/2008 Mirchandani
2008/0164747 A1 7/2008 Weaver et al.
2008/0284234 A1 11/2008 Hall et al.
2009/0146491 A1 6/2009 Fader et al.
2009/0160238 A1 6/2009 Hall et al.
2009/0256413 A1 10/2009 Majagi
2009/0261646 A1 10/2009 Ritchie et al.
2010/0045094 A1 2/2010 Sollami
2010/0244545 A1 9/2010 Hall
2010/0253130 A1 10/2010 Sollami
2010/0320003 A1 12/2010 Sollami
2010/0320829 A1 12/2010 Sollami
2011/0006588 A1 1/2011 Monyak et al.
2011/0089747 A1 4/2011 Helsel
2011/0175430 A1 7/2011 Heiderich et al.
2011/0204703 A1 8/2011 Sollami
2011/0254350 A1 10/2011 Hall
2012/0001475 A1 1/2012 Dubay et al.
2012/0027514 A1 2/2012 Hall
2012/0056465 A1* 3/2012 Gerer ..... E21C 35/183 299/29
2012/0068527 A1 3/2012 Erdmann
2012/0104830 A1 5/2012 Monyak et al.
2012/0181845 A1 7/2012 Sollami
2012/0242136 A1 9/2012 Ojanen
2012/0248663 A1 10/2012 Hall
2012/0261977 A1 10/2012 Hall
2012/0280559 A1 11/2012 Watson
2012/0286559 A1 11/2012 Sollami
2012/0319454 A1 12/2012 Swope
2013/0169023 A1 7/2013 Monyak
2013/0181501 A1 7/2013 Hall et al.
2013/0199693 A1 8/2013 Tank et al.
2013/0307316 A1 11/2013 Roetsch et al.
2014/0035346 A1 2/2014 Fundakowski et al.
2014/0110991 A1 4/2014 Sollami
2014/0232172 A1 8/2014 Roth et al.
2014/0262541 A1 9/2014 Parsana et al.
2014/0326516 A1 11/2014 Haugvaldstad
2015/0028656 A1 1/2015 Sollami
2015/0035343 A1 2/2015 Ojanen
2015/0137579 A1* 5/2015 Lachmann ..... B28D 1/188 299/10
2015/0198040 A1 7/2015 Voitic et al.
2015/0240634 A1 8/2015 Sollami
2015/0240635 A1* 8/2015 Lachmann ..... C22C 26/00 299/105
2015/0285074 A1 10/2015 Sollami
2015/0292325 A1 10/2015 Sollami
2015/0300166 A1* 10/2015 Ries ..... E21C 35/1933 299/105
2015/0308488 A1 10/2015 Kahl
2015/0315910 A1 11/2015 Sollami
2015/0354285 A1 12/2015 Hall
2016/0102550 A1 4/2016 Paros et al.
2016/0194956 A1 7/2016 Sollami
2016/0229084 A1 8/2016 Lehnert

(56) References Cited

U.S. PATENT DOCUMENTS

| | | | |
|---|---|---|---|
| 2016/0237818 | A1 | 8/2016 | Weber et al. |
| 2017/0089198 | A1 | 3/2017 | Sollami |
| 2017/0101867 | A1 | 4/2017 | Hall et al. |

FOREIGN PATENT DOCUMENTS

| | | | |
|---|---|---|---|
| DE | 202012100353 | | 6/2013 |
| DE | 102015121953 | | 7/2016 |
| DE | 102016118658 | | 3/2017 |
| EP | 3214261 | | 9/2017 |
| GB | 1114156 | | 5/1968 |
| GB | 1218308 | | 1/1971 |
| GB | 2483157 | | 2/2012 |
| GB | 2534370 | | 7/2016 |
| WO | 2008105915 | A2 | 9/2008 |
| WO | 2008105915 | A3 | 9/2008 |
| WO | 2009006612 | | 1/2009 |

* cited by examiner

BIT TIP INSERT

CROSS-REFERENCE TO RELATED APPLICATION(S)

This application claims priority to and is a continuation-in-part of U.S. Provisional Application No. 61/974,064, filed Apr. 2, 2014, claims priority to and is a continuation-in-part of U.S. Non-provisional application Ser. No. 14/676,364, filed Apr. 1, 2015, and claims priority to and is a continuation-in-part of U.S. Non-provisional application Ser. No. 15/923,051, filed Mar. 16, 2018, to the extent allowed by law and the contents of which are incorporated herein by reference in their entireties.

TECHNICAL FIELD

This disclosure relates to improved bit/bit holder combinations and, more particularly, to such a combination utilizing a diamond layered and/or coated generally conical tip insert.

BACKGROUND

As basic infrastructure created in the 20th Century ages and wears, machinery for rejuvenating or replacing that infrastructure has become more important. While mining and trenching operation machinery may be included in this technology, road milling machinery, down hole tools in the oil well industry, and other similar industries area, thus far, the most prolific use of the instant machinery.

Road milling equipment utilizes a rotating drum having a plurality of bit assemblies removably mounted on the outside of the drum in spiral or chevron orientation. A typical rotating drum has a bit tip to bit tip diameter of between 42 and 54 inches and includes a plurality of mounting blocks generally secured thereto by welding in spiral or chevron patterns. The patterns noted provide for the bit blocks to be mounted behind and slightly axially to the side of one another such that the bits or combination bit/holders mounted in each bit block may have the tips of the bits positioned in close proximate relation along the axial length of the drum. As such, adjacent bit tips may be positioned anywhere from about 0.200 inch to about ⅝ inch axially apart for either removing concrete, asphalt, or the like, when replacing one or both of the pavement and underlayment for roadways, or may be positioned axially closer together, about 0.200 inch, for micro milling the surface of pavement to remove buckles, create grooves on curved surfaces such as cloverleafs, or the like.

Improvements in the bits and bit/holders that are removably mounted on the bit blocks have increased the useful in-service life of those removable parts. While such bit and bit/holders have been made of steel and hardened materials such as tungsten carbide, the use of diamond coated tips and man-made PCD (polycrystalline diamond) tips, has been shown to increase the in-service life of those bits and bit/holders.

Another improvement in bit/holders has been the invention of quick change holders that have eliminated the necessity of securing such holders with threaded nuts or retaining clips and have utilized the compressive elastic ductility of hardened steel to provide sufficient radial force between the holders and the bit block bores to retain holders mounted in their respective bit block bores during operation. While such bit assemblies have included rotatable and removable bits mounted in bit holders which, in turn, were mounted in bit blocks as noted above, the introduction of diamond materials on bit tips has increased their in-service life 40 to 80 times and has, in some cases, allowed for the combining of bits and bit holders into a unitary construction with the tips no longer being rotatable on the holders.

A need has developed for improved structure at the front leading end or tip end of bit/holders that provide for improved wear characteristics, in-service life and finer milled road surfaces at reduced total cost.

SUMMARY

This disclosure relates generally to bit and/or pick assemblies for road milling, mining, and trenching equipment. One implementation of the teachings herein is a bit tip insert that includes a body including a diameter of at least five-eighths inch at a widest part of the body, the body including a tip including a substrate and an overlay on an outer surface of the substrate; and a base subjacent the tip, the base including a tapered sidewall.

In another implementation of the teachings herein is a bit tip insert that includes a body including a diameter of at least five-eighths inch at a widest part of the body, the body including a tip including a substrate and an overlay on an outer surface of the substrate; and a base subjacent the tip, the base including a cylindrical sidewall.

These and other aspects of the present disclosure are disclosed in the following detailed description of the embodiments, the appended claims and the accompanying figures.

BRIEF DESCRIPTION OF THE DRAWINGS

The features of the present disclosure which are believed to be novel are set forth with particularity in the appended claims. The disclosure may best be understood from the following detailed description of currently illustrated embodiments thereof taken in conjunction with the accompanying drawings wherein like numerals refer to like parts, and in which:

DETAILED DESCRIPTION

The diameter of the base of the PCD ballistic insert is determined by the required geometric profile of the forward end of the point attack tool. As the machine or equipment size diminishes, so does the amount of horsepower of the engine or the machine needed to operate the machine.

The ballistic or parabolic style profile of the tip of the PCD insert provides a longer conic tip than a standard straight line side profile of a frustoconical tip. The longer parabolic tip has a greater PCD coated length with more structural strength. The included angle of the tip varies axially. Sollami PCD tool is 180 degrees indexable to achieve extended life over prior art diamond coated tools, while maintaining nearly exactly the same cut surface profile.

Figure 1:
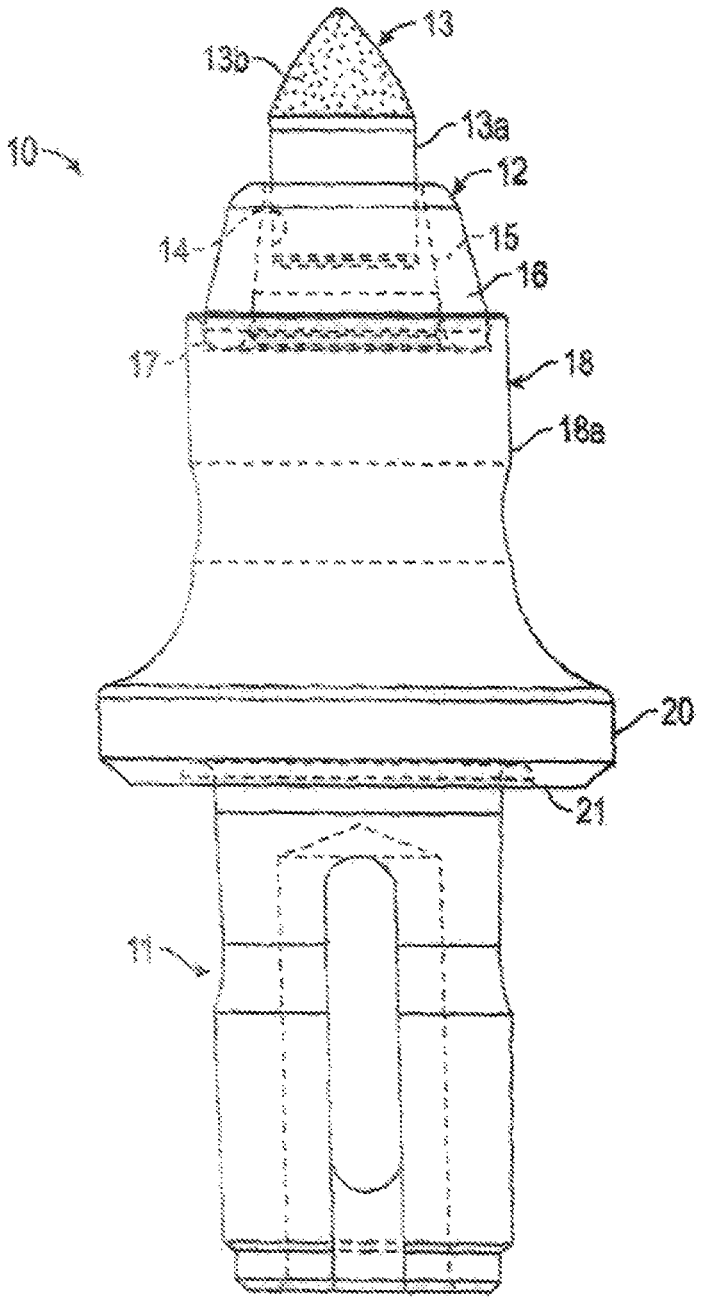
FIG. 1 is a front elevational view of a first embodiment of a bit/holder constructed in accordance with the present disclosure including a first embodiment of an improved and enlarged leading tip section.

Referring to FIGS. 1 and 2, a first embodiment of a bit/holder 10, constructed in accordance with the present disclosure, includes features from this inventor's previous U.S. Pat. Nos. 6,371,567, 6,585,326 and 6,739,327 which show both the shank 11 at the rear of the bit/holder and the forward end 12 of the bit/holder 10 having a diamond coated tungsten carbide tip insert 13 mounted in a generally cylindrical recess 14 at the center of an annular flange 15 extending axially outwardly from the steel body portion of the bit/holder. This steel annular flange 15 provides ductility and shock absorption characteristics to the generally ballistic shape tip 13 that is preferably made of tungsten carbide having either a single 13*b* or multiple layer (See FIG. 6) of industrial diamond or PCD superstructure over the forward conical portion of the tip. Additionally, an annular ring 16 of tungsten carbide is mounted over the steel annular flange 15 for added wear resistance to the aft portion of holder. The tungsten carbide annular ring 16 is preferably brazed in an annular groove 17 at the top of the body portion 18 of the holder 10.

In the illustrated embodiment of the bit/holder 10 when used for road milling purposes, the nominal outer diameter of the shank 11 is about 1.5 inches and the nominal outer diameter of the widest portion of the body 18 of the holder is about 2⅝ inches at what is termed the "tire portion" 20 of the holder body 18. The diameter of the upper cylindrical portion 18*a* of the body 18 is about 1¾ inches and the axial length of the body from the rear annular flange 21 to the front of the cylindrical portion is about 3 inches. The length of the shank 11 in the embodiments shown approximates 2½ inches. As taught in my U.S. Provisional Patent Application No. 61/944,676, filed Feb. 26, 2014, now U.S. Non-provisional patent application Ser. No. 14/628,482, filed Feb. 23, 2015, and now U.S. Patent Application Publication No. 2015/0240634, published Aug. 27, 2015, the contents of which are incorporated by reference, bit holder shanks may be shorter, on the order of 1½ inches.

With the forward cylindrical end of a bit holder body 18 having a diameter of about 1¾ inches, prior art bits or pick bolsters have been designed to have a conical surface aiding in diverting pavement material away from the forward tip portion of the bit/holder or bit.

In designing these structures, tip inserts having a front conical tip of PCD or diamond layered material 13*b*, as shown in FIG. 1, have been selected to provide best results. The diameter of the tip insert at its widest point for holders sized as above has thus far been a tip insert made to a base diameter of about 0.565 inch. In experimenting with such diamond covered tip insert structures, applicant has discovered that using such a tip having a nominal diameter of 0.625, 0.75, 0.875 inch or larger ballistic tip insert may still be inserted in a modified structure substantially similar to that previously shown in U.S. Pat. No. 6,739,327. Thus, the improvement is also compatible with existing drums and bit holder blocks. This illustrated ¾ inch or larger diameter ballistic shaped tip insert 40 is also longer (See FIG. 6) in overall length than the 0.565 inch diameter prior insert utilized.

Figure 4:
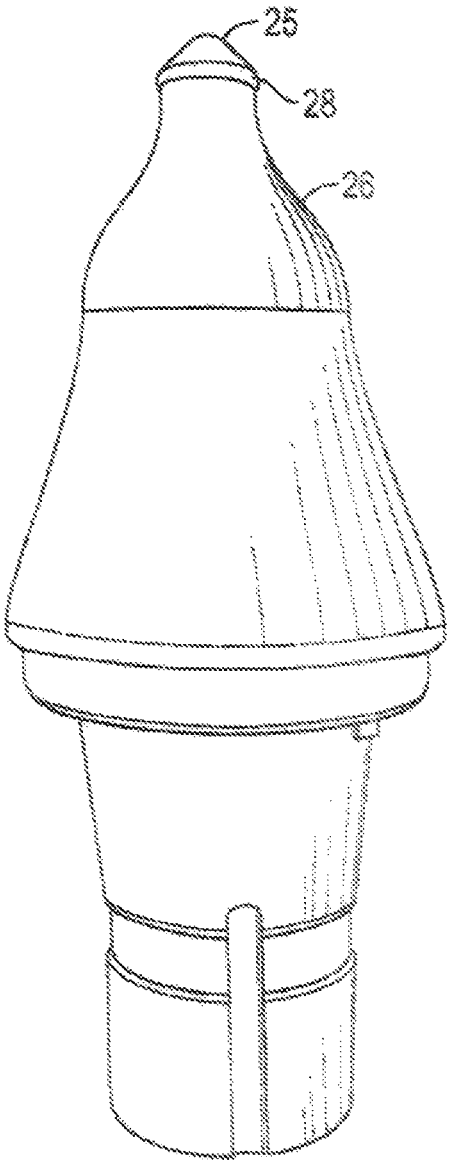
FIG. 4 (Prior Art)
FIG. 4 is a photograph showing a front elevational view of a prior art bit/holder after substantial in-service use showing the wear characteristics on it after substantial use.
Figure 5:
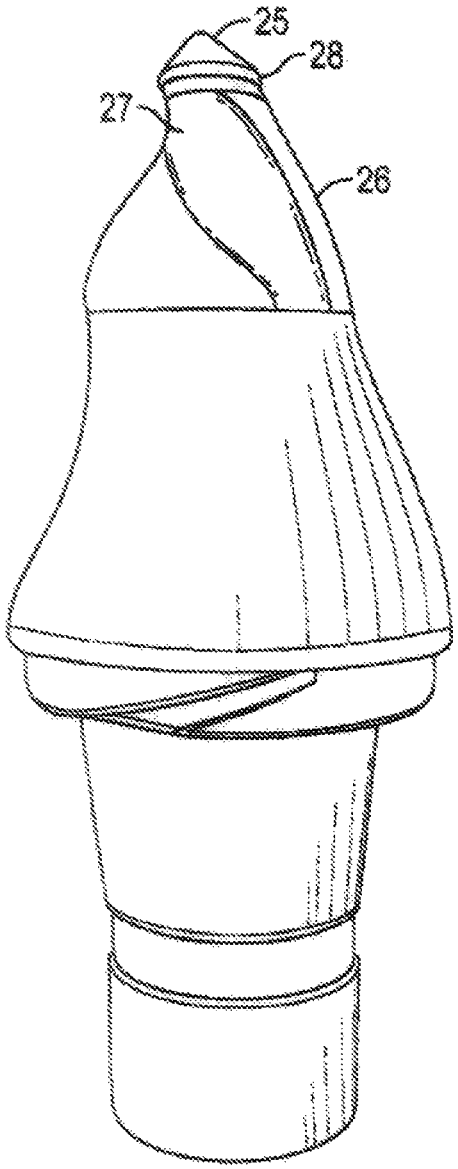
FIG. 5 (Prior Art)
FIG. 5 is a photograph showing a side elevational view of the prior art bit/holder shown in FIG. 4 wherein separated material has flowed past the left side of the bit/holder in use.

The overall length of the ¾ inch diameter ballistic tip insert is about 1⅛ inches. This length when mounted in the cylindrical recess 14, having a diameter of at least 0.625 inch, at the front of the bit holder body 18 allows the ballistic tip insert 13 to extend at least ⅝ inch from the front of the annular tungsten carbide collar 16 and to extend at least ½ inch outwardly of recess 14. When coating tungsten carbide inserts with diamond, high temperature, high pressure presses are used. Making more 0.565 diameter inserts has thus far yielded slightly cheaper inserts, but applicant has found that making fewer, larger inserts per manufacturing operation at cycle yields better milling results, although each insert is made at a slightly higher cost. Referring to FIGS. 4 and 5, the wear pattern of a prior art PCD insert tip 25 attached to a tungsten carbide bolster bit/holder 26 of prior art 0.565 inch tip diameter is shown. The conical portion of the ballistic tip insert 25 shows some wear after substantial use of the tool. Most of the wear occurs immediately aft 27 of the widest part 28 of the tip insert. This wear occurs in the product shown on both sides in FIG. 4 and on the left (loosened material flow side in FIG. 5) in what is termed a "tungsten carbide bolster" 26 that initially is generally frustoconical in shape with a slightly convex worn outer surface. The right side of the tip 25 in FIG. 5 slides along the remaining roadway material. As shown in FIGS. 4 and 5, this PCD conical front tip 25 extends minimally away from the front of the tungsten carbide bolster 26. It is submitted that the additional ⅝ inch extension of the improved ¾ inch or larger diameter ballistic tip insert of the present disclosure urges removed asphalt and concrete material away from the tip 13 at the area of most wear (the left side of FIG. 5 in the prior art) and thus provides reduced wear on the annular ring.

Figure 2A:
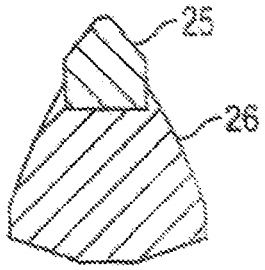
FIG. 2A (Prior Art)
FIG. 2*a* is a cross section view of a prior art 0.565 inch PCD tip insert mounted on a recess in a pick bolster.
Figure 2B:
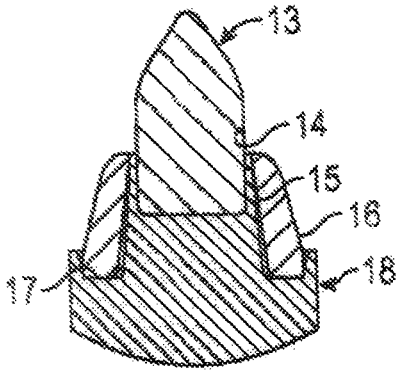
FIG. 2*b* is a fragmentary cross section view of the 0.75 inch diameter PCD layered tip insert as in FIG. 1 shown for comparison purposes with the prior art disclosed on the other FIG. 2 drawings.

Referring to FIGS. 2*a*, 2*b*, 2*c* and 2*d*, the bit tip insert 13 of the disclosure shown in FIG. 2*b* is compared with prior art 0.565 inch diameter conical tips shown in FIG. 2*a*. The added diamond coated conical area of the new tip 13 of FIG. 2*b*, shown in FIG. 2*c* solid line 13 at the sides of the prior art tip of FIG. 2*a* at 25, provides substantially greater diamond protected cutting area than the prior art. This added area, when used on neighboring like sized tips, on ⅝ inch center-to-center drums, provides substantial cutting overlap on pavement to be milled.

Figure 2C:
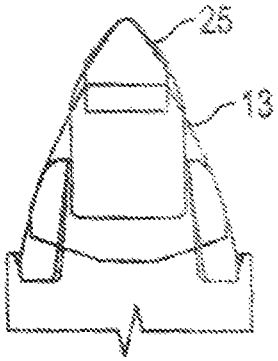
FIG. 2*c* is a diagram view showing the prior art tip of FIG. 2*a* superimposed on the front portion of the enlarged tip of FIG. 2*b;*
Figure 2D:
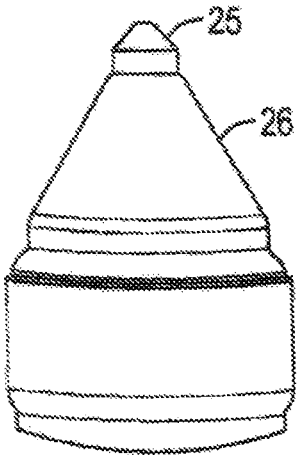
FIG. 2D (Prior Art)
FIG. 2*d* is a fragmentary photograph of another prior art tip having a 0.565 inch diameter conical distal end.

FIGS. 2*a* and 2*d* show prior art 0.540 to 0.565 inch PCD inserts 25 which have conical PCD tips brazed to tungsten carbide bases mounted on a pick bolster 26 made of tungsten carbide.

FIG. 2*c* shows the outlines of tip insert 13 of the present disclosure as mounted in a bit holder with the prior art 0.565 tip and bolster of FIG. 2*a* superimposed at 25 thereon. As in FIG. 2*b*, the added (enlarged) diamond coated conical portion over this piece of prior art can readily be seen with similar advantages as discussed above. The profiles toward the top of the bit insert are similar, but the height of the tapered portion is greater than a 0.565 inch PCD tip producing better wear protection to the annular carbide ring as will be discussed below.

FIG. 2*d* shows another prior art 0.565 diamond tip insert 25. Applicant's 0.75 inch conical tip insert would provide similar advantages over this tip as mentioned in connection with FIG. 2*c* above.

Figure 3:
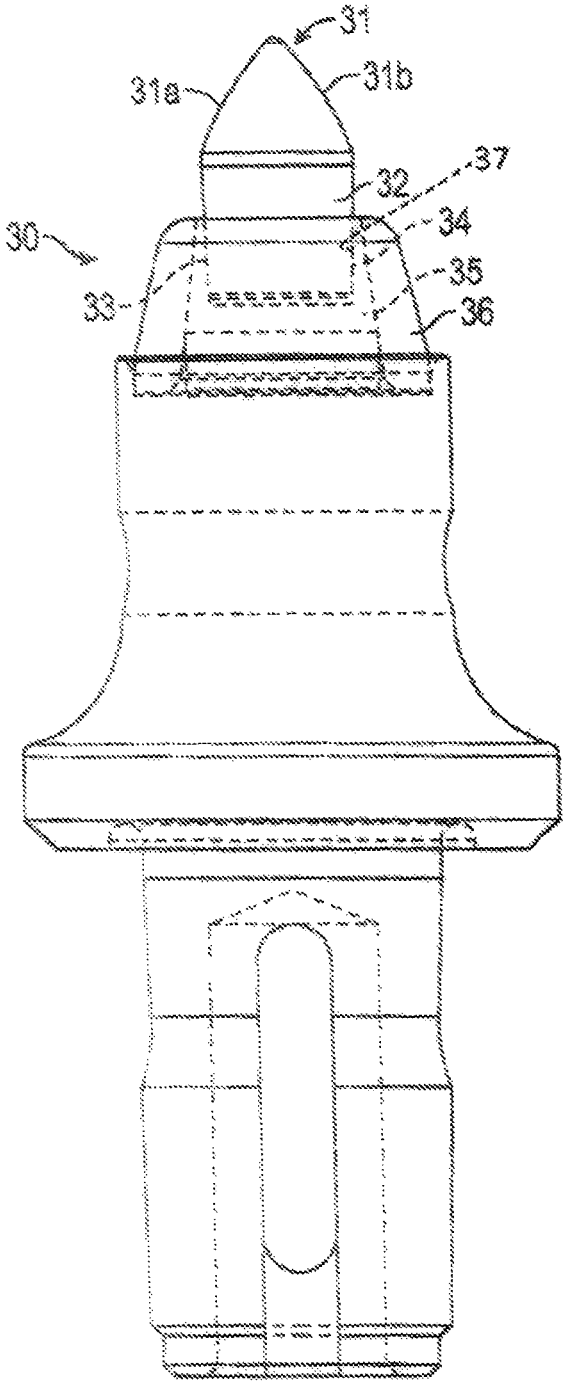
FIG. 3 is a front elevational view of a second embodiment of a bit/holder constructed in accordance with the disclosure showing a second embodiment of a tip having a slight reverse taper in the aft or body portion thereof which is mounted on the front of the holder portion thereof.

FIG. 3 shows a second embodiment of a bit/holder 30 of the present disclosure utilizing a 0.75 inch nominal diameter diamond covered conical tip 31 with a tungsten carbide base 32 that is slightly reverse tapered at its sides 33, 34 at approximately a 2 degree half angle in this illustrated embodiment, that is, 2 degrees per side. In other embodiments, the tungsten carbide base 32 is slightly reverse tapered at its sides 33, 34 in the range of and including 1/100 of 1 degree to 15 degrees per side).

While prior art bits and bit/holders disclose an enlarged tungsten carbide conical portion just aft of the 0.565 inch base insert with PCD shaped tip, the present disclosure, having a steel annular tubular column 35 having a recess 37 (FIG. 3) into which the 0.75 diameter PCD insert 31 is inserted, provides additional shock absorbing characteristics as a result of the ductility of the steel and subjacent braze joint. Prior art PCD tungsten carbide inserts brazed to tungsten carbide bases do not possess those shock absorbing capabilities. The central steel annular tubular column 35 also provides for greater thermal expansion and contraction during use. As the forward end of the PCD insert 31 increases its working temperature, the steel column 35 and the braze joint will expand about twice the amount of tungsten carbide expansion for the same increase in temperature and radially grab the PCD insert 31 more securely. The carbide collar 36 restricts the steel column 35 from similarly expanding outwardly. The steel tubular column 35 has about twice the coefficient rate of thermal expansion value as tungsten carbide.

Thus, improved bit/holders 10, 30, utilizing a ballistic shape tip of an increased diameter from 0.565 inch to 0.75 inch and larger provides a superior product than previously known in the art while still being usable with present size bit holder blocks (not shown).

Figure 6:
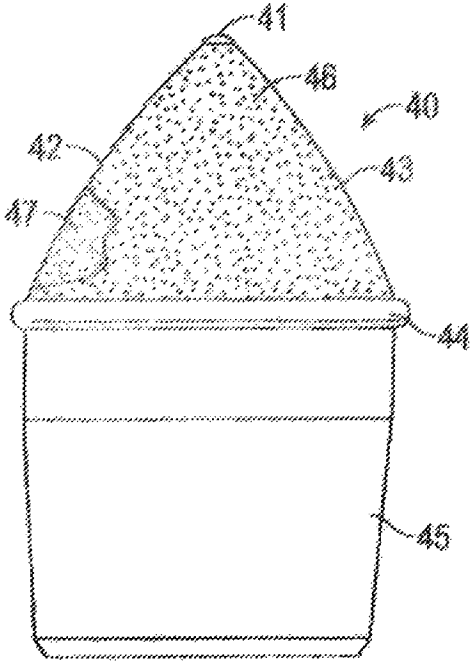
FIG. 6 is an enlarged diagrammatic elevational detail view of a third embodiment of the enlarged tip insert.

Referring to FIG. 6, a third embodiment of a ballistic shaped diamond coated tungsten carbide insert 40 is shown. A tip such as shown in the first embodiment could include a frustoconical tip having an approximately ⅛ inch curved radius at the top 41 thereof, and straight or parabolic conical sides leading down to the widest part of the base 44. Also, the tip 13 shown in the first embodiment has a cylindrical base 13*a* that extends at least about ¾ inch behind the generally conical tip 13, which fits into the cylindrical recess 14 at the top of the body 18 of the holder 10 in the first embodiment and is brazed into recess 14.

In the second embodiment of the bit/holder 30, the tip 31 shown in FIG. 3 and the third embodiment of the tip 40 of FIG. 6 also include an approximate ⅛ inch curved top. The sides 31*a*, 31*b* (FIG. 3) of the conical portion of the insert are parabolic in shape. An additional ⅛ inch thereafter, the parabola shape changes to a 60½ degree separation and another ⅛ inch down from there the separation changes to an approximate 51 degree separation.

The parabolic shape of the ballistic tip 31 provides more mass under the multi layered diamond coating than would a straight side conical tip. Additionally, the top of the parabolic tip 31 provides improved separation of the material removed from the base thereof and directs the material removed further away from the base of the tip.

As shown, the base 32 of the tip 31 in the second embodiment is ¾ inch in diameter and in the second embodiment includes a 2 degree per side taper toward the bottom of the insert which is about a total 1 inch to 1.5 inches in height.

As mentioned previously, it appears from the drawing shown in FIG. 3, that an important factor for wear in the bit/holder is the width of the base of the tip in the insert. While prior art inserts have been approximately 0.565 inch in diameter, increasing that diameter to 0.75 inch and larger provides a wider base at the point of greatest wear during use of such a bit/insert. Thus the use of a 0.75 inch or greater diameter insert base provides for greater longevity of use. Also, larger bit holders are utilized for trenching and mining operations, so larger bit inserts can be utilized there. Further, the increased length of the insert to 1 inch in length or greater allows at least a ⅝ inch exposed length of the insert that also directs material removed away from the base of the insert to decrease the wear in what FIGS. 4 and 5 show as the most sensitive part of the wear for a bit/holder during use.

The third embodiment of the diamond coated tip 40 shown in FIG. 6 differs from that shown in FIG. 3 in that the diamond coating 46 includes a ridge or overfill portion 44 at the base of the parabolic curves 42, 43 that has a thickness of about 0.010 inch or more per side. The overfill or over formed portion 44 may not be regular in shape and does not need to be ground or removed into any specific shape. This added diameter also affects the shape of the finished surface as will be discussed in more detail below. Depending upon the grade of diamond material or PCD material used, this thickness of the diamond coating may typically be about 0.120 inch or less. Multiple layers of diamond coating 46, 47, as shown in FIG. 6, may be overlayed on the bit tip 40. It should be noted that with the greater diameter and outward extending diamond edge overfill 44 of the increased tip 40 shown in FIG. 6, a thinner diamond or PCD coating at 46, 47 may be utilized in adjusting wear characteristics vs. cost. It should be noted that the conical area of a 0.75 inch diameter cone at the tip includes over 3.5 times the area of a 0.565 inch tip, providing a substantially more massive cutting tool.

Figure 7:
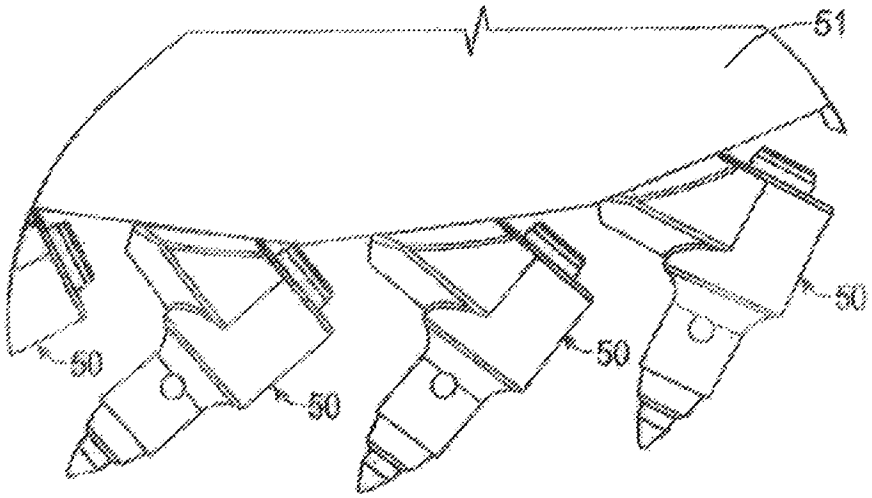
FIG. 7 is a diagrammatic stop motion side view of the partial sweep of a bit assembly as it moves through its material separating operation.
Figure 8:
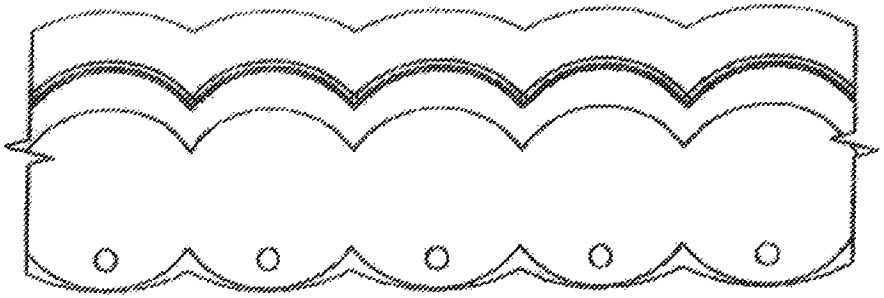
FIG. 8 is a diagrammatic front view taken at 90 degrees to FIG. 7 showing the added side overlap of successive bit assemblies resulting in a finer finish cut using a drum with standard 0.625 inch center-to-center tip spacing.

Referring to FIGS. 7 and 8, a plurality of cutting tools 50-50, constructed in accordance with the present disclosure, are shown sweeping across the cutting area of a surface to be removed. As previously described, the increased outer diameter of the bit tip to 0.75 inch adds mass to the exact area where most wear during use occurs. This increased cross section creates a shallow depth pattern as needed in micro milling, without requiring additional machine horsepower.

As previously discussed, a plurality of these bit assemblies 50-50 are mounted on cylindrical drum 51 in spiral or chevron fashion. A typical drum being about 7 feet to about 13 feet in length and typically 42 to 54 inches in diameter, may hold around 168 to 650 bit assemblies with center-to-center axial spacing of 0.625 inch between bit assemblies. This is in what is termed a "standard drum" previously used for removal of not only surface material, but also substrate material. Previously, drums used for micro milling have had center-to-center tip axial spacing of 0.20 inch between tips. As such, drums used for micro milling may have about 325 bit assemblies for same 7 feet 2 inch length drum. This is in drums term "double or triple hit drums," double hit drums may have about 25 percent more of the bit assemblies. Full lane micro milling drums that are about 13 feet in length may have 600 to 900 bit assemblies per drum at a 0.200 inch center-to-center axial tip spacing.

Applicant has found that the use of ¾ inch nominal diameter or larger diamond coated bit tips when used at ½ to 1 inch depth of cut at approximately 92 rpm drum rotation speed and at a travelling speed of 20-40 ft/min may provide a surface approaching or equal to the flatness of a micro milled surface previously obtained with 0.565 inch diameter bit tips on drums having 0.200 inch center-to-center bit separation with same machine cutting specifications.

FIG. 8 shows a diagram of succeeding 0.75 inch bit tips of the present disclosure spaced at 0.625 inch apart which gives an axial overlap between adjacent bit tips of about 0.125 inch. This overlap is also at the point of most vertical curvature for even a ½ inch depth of the cut, leaving a substantially flatter surface than would be obtained using the 0.565 inch diameter bit tips. The fineness of the residual surface is also obtained by moving the drum at a slower speed (15-25 fpm). The faster in feet per minute the drum travels forward, the rougher the cut. It is therefore necessary not to outrun the cut. A speed of 60-120 feet per minute is considered normal for a rough cut.

As noted, the resulting fineness of the surface milled using the larger diameter bit tip approaches or achieves micro milling flatness by utilizing standard center-to-center diameter drums instead of the more expensive drums presently made for micro milling operations. Additional fineness of cut can be achieved by modifying spacing to somewhat less than 0.625, but substantially greater than 0.2 inch center-to-center. Not only is the cost of the drum less, but utilizing fewer bit assemblies makes a lighter drum requiring less horsepower to operate with more fuel efficiency and less impact on the machine components.

Figure 9:
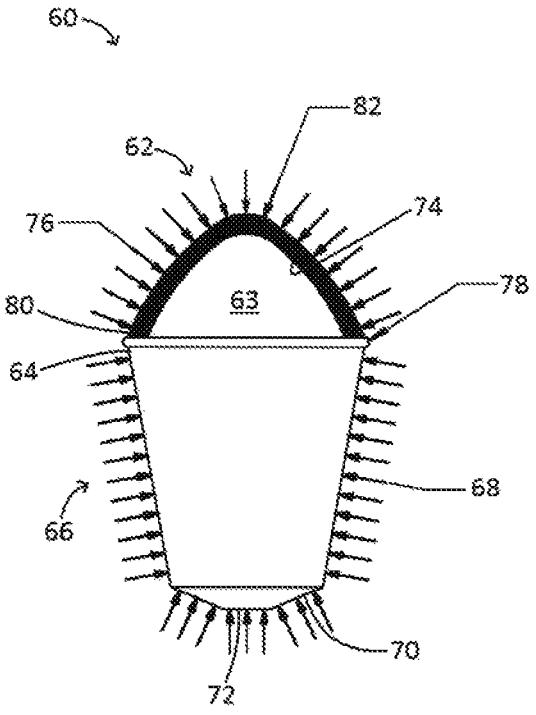
FIG. 9 is a side elevation view of a fourth embodiment of a tip insert in accordance with implementations of this disclosure.

Referring to FIG. 9, a fourth embodiment of a tip insert 60 of the present disclosure is shown. The tip insert 60 comprises a generally conical tip 62 at a forward end 64 of a base 66 that includes a parabolic curved section below an apex of the tip insert 60. The tip 62 can also have a frustoconical shape, a flat generally cylindrical puck shape, a parabolic ballistic shape, and/or an arcuate shape. In one exemplary implementation of the fourth embodiment, the tip insert 60 can have a diameter in the range of ⅝ inch to 1.250 inch. The base 66 comprises a complementary shaped declining tapered outer surface or sidewall 68 that is adapted to be mounted in a complementary shaped forward end of a unitary bit/holder, tool, and/or pick. In this fourth embodiment, the base 66 includes a frustoconical portion 70 adjacent a distal end 72 of the base 66. The outer surface 68 may require grinding or other additional finishing processes, while the frustoconical portion 70 and the distal end 72 of the base 66 do not require additional finishing processes, such as grinding. The base 66 may be made of steel or tungsten carbide and includes the tip 62 at the outer or forward end 64 of the base 66. In this embodiment, the base 66 is made primarily of tungsten carbide and the tip 62 comprises a substrate 63 that is primarily made of tungsten carbide. As described in Applicant's U.S. Pat. No. 6,199,451, powdered tungsten carbide and a powdered binder, such as cobalt or nickel, which are premixed together, are compacted within a generally tubular die by punches pressing against the tip 62 and the base 66 which forms a finished tungsten carbide component that includes the tip profile. The forces which compress the particles of powdered tungsten carbide are exerted perpendicular to the surfaces of the tip 62 and base 66, as shown by the various arrows.

An overlay 76 of a polycrystalline diamond structure is placed on an outer surface or forward end 74 of the tip 62 of the finished tungsten carbide component. The overlay 76 may also be made of an industrial diamond material and may include a single coating or outer layer or multiple coating or outer layers of such industrial diamond material, natural diamond, polycrystalline diamond (PCD) material, and polycrystalline diamond composite and/or compact (PDC) material. The single or multiple coatings or layers of the overlay 76 may be formed by a high pressure, high temperature (HPHT) process. The finished tungsten carbide component, which includes the tip 62 and the base 66, and the overlay 76 on the forward end 64 of the tip 62 are centered and placed in a can or metal enclosure and a plurality of hydraulic pistons apply pressure and force on the can over time during the HPHT process, compressing and/or pressing the tip 62 and base 66 again. The HPHT process liquefies the binder material, such as cobalt in this embodiment, which migrates toward the overlay 76 and binds to the diamond and tungsten carbide producing a stronger form. The diamond to diamond bond in the overlay 76 and tip 62 is created by the catalytic attachment of the cobalt within the small cavities of diamond crystals in the overlay 76.

During the HPHT process, excess PCD material 78 forms a bulge or small flash between a distal end 80 of the tip 62 and the forward end 64 of the base 66. The excess PCD material 78 can be used as formed on tools that are used in milling, trenching, mining, and similar applications. The overlay 76 occupies a large radial and axial profile of the tip 62 which allows faster heat transfer into a region subjacent to the overlay 76 PCD layer. Excessively high heat, such as temperatures above 1300 degrees F., is the greatest cause of PCD failure due to diamond connective failure, the quick heat transfer from the tip 62 of the PCD cutting zone to the subjacent region below the PCD drastically reduces the possibility of a temperature of the tip 62 of the PCD reaching temperatures at or above 1300 degrees F. for any extended period of time thereby avoiding failure of the PCD layer. Furthermore, a tapered base sidewall, such as the tapered outer surface 68 of base 66, on a PDC insert provides a greater concentration of forces applied at the forward PCD overlay 76 and tungsten carbide interface in tip 62 than when using a cylindrical, non-tapered base sidewall and the HPHT process. All external forces 82 are applied at right angles to the tapered outer surface of the tip insert 60, which depends on the vector force directed axially towards the tip 62.

Figure 10:
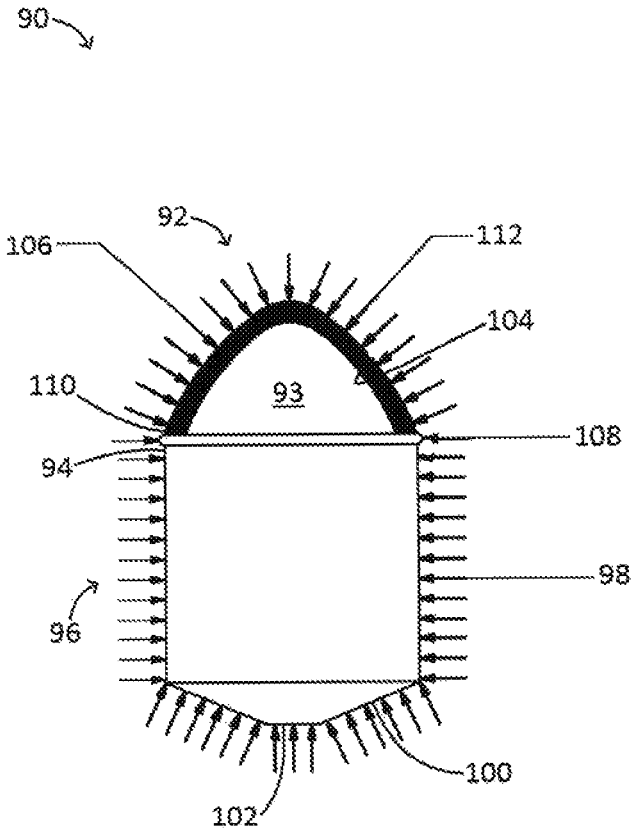
FIG. 10 is a side elevation view of a fifth embodiment of a tip insert in accordance with implementations of this disclosure.

Referring to FIG. 10, a fifth embodiment of a tip insert 90 of the present disclosure is shown. The tip insert 90 comprises a generally conical tip 92 at a forward end 94 of a base 96 that includes a parabolic curved section below an apex of the tip insert 90. The tip 92 can also have a frustoconical shape, a flat generally cylindrical puck shape, a parabolic ballistic shape, and/or an arcuate shape. In one exemplary implementation of the fifth embodiment, the tip insert 90 can have a diameter in the range of ⅝ inch to 1.250 inch. The base 96 comprises a complementary shaped cylindrical outer surface or sidewall 98 that is adapted to be mounted in a complementary shaped forward end of a unitary bit/holder, tool, and/or pick. In this fifth embodiment, the base 96 includes a frustoconical portion 100 adjacent a distal end 102 of the base 96. The outer surface 98 may require grinding or other additional finishing processes, while the frustoconical portion 100 and the distal end 102 of the base 96 do not require additional finishing processes, such as grinding. The base 96 may be made of steel or tungsten carbide and includes the tip 92 at the outer or forward end 94 of the base 96. In this embodiment, the base 96 is primarily made of tungsten carbide and the tip 92 comprises a substrate 93 that is primarily made of tungsten carbide. Powdered tungsten carbide and a powdered binder, such as cobalt or nickel, which are premixed together, are compacted within a generally tubular die by punches pressing against the tip 92 and the base 96 which forms a finished tungsten carbide component that includes the tip profile. The forces which compress the particles of powdered tungsten carbide are exerted perpendicular to the surfaces of the tip 92 and base 96, as shown by the various arrows.

An overlay 106 of a polycrystalline diamond structure is placed on an outer surface or forward end 104 of the tip 92 of the finished tungsten carbide component. The overlay 106 may also be made of an industrial diamond material and may include a single coating or outer layer or multiple coating or outer layers of such industrial diamond material, natural diamond, polycrystalline diamond (PCD) material, and polycrystalline diamond composite and/or compact (PDC) material. The single or multiple coatings or layers may be formed by a high pressure, high temperature (HPHT) process. The finished tungsten carbide component, which includes the tip 92 and the base 96, and the overlay 106 on the forward end 104 of the tip 92 are centered and placed in a can or metal enclosure and a plurality of hydraulic pistons apply pressure and force on the can over time during the HPHT process, compressing and/or pressing the tip 92 and base 96 again. The HPHT process liquefies the binder material, such as cobalt in this embodiment, which migrates toward the overlay 106 and binds to the diamond and tungsten carbide producing a stronger form. The diamond to diamond bond in the overlay 106 and tip 92 is created by the catalytic attachment of the cobalt within the small cavities of diamond crystals in the overlay 106.

During the HPHT process, excess PCD material 108 forms a bulge or small flash between a distal end 110 of the tip 92 and the forward end 94 of the base 96. The excess PCD material 108 can be used as formed on tools that are used in milling, trenching, mining, and similar applications. The overlay 106 occupies a large radial and axial profile of the tip 92 which allows faster heat transfer into a region subjacent to the overlay 106 PCD layer. Excessively high heat, such as temperatures above 1300 degrees F., is the greatest cause of PCD failure due to diamond connective failure, the quick heat transfer from the tip 92 of the PCD cutting zone to the subjacent region below the PCD drastically reduces the possibility of a temperature of the tip 92 of the PCD reaching temperatures at or above 1300 degrees F. for any extended period of time thereby avoiding failure of the PCD layer. Furthermore, all external forces 112 are applied at 90 degrees to the centerline on the cylindrical sidewall 98 of the base 96 and at right angles to the outer surface of the tip 92.

Figure 11:
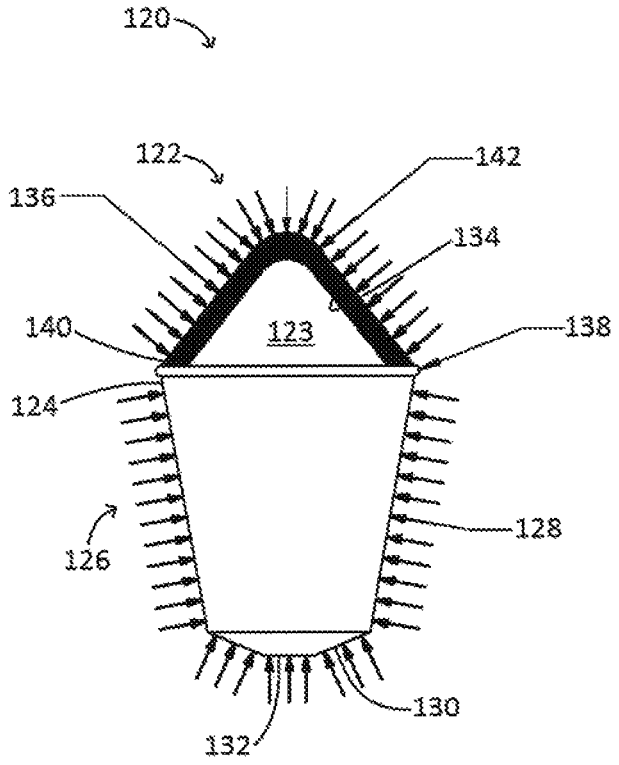
FIG. 11 is a side elevation view of a sixth embodiment of a tip insert in accordance with implementations of this disclosure.

Referring to FIG. 11, a sixth embodiment of a tip insert 120 of the present disclosure is shown. The tip insert 120 comprises a generally conical tip 122 at a forward end 124 of a base 126 that includes a conical or angular section below an apex of the tip insert 120. The tip 122 can also have a frustoconical shape, a flat generally cylindrical puck shape, a parabolic ballistic shape, and/or an arcuate shape. In one exemplary implementation of the sixth embodiment, the tip insert 120 can have a diameter in the range of ⅝ inch to 1.250 inch. The base 126 comprises a complementary shaped declining tapered outer surface or sidewall 128 that is adapted to be mounted in a complementary shaped forward end of a unitary bit/holder, tool, and/or pick. In this sixth embodiment, the base 126 includes a frustoconical portion 130 adjacent a distal end 132 of the base 126. The outer surface 128 may require grinding or other additional finishing processes, while the frustoconical portion 130 and the distal end 132 of the base 126 do not require additional finishing processes, such as grinding. The base 126 may be made of steel or tungsten carbide and includes the tip 122 at the outer or forward end 124 of the base 126. In this embodiment, the base 126 is primarily made of tungsten carbide and the tip 122 comprises a substrate 123 that is primarily made of tungsten carbide. Powdered tungsten carbide and a powdered binder, such as cobalt or nickel, which are premixed together, are compacted within a generally tubular die by punches pressing against the tip 122 and the base 126 which forms a finished tungsten carbide component that includes the tip profile. The forces which compress the particles of powdered tungsten carbide are exerted perpendicular to the surfaces of the tip 122 and base 126, as shown by the various arrows.

An overlay 136 of a polycrystalline diamond structure is placed on an outer surface or forward end 134 of the tip 122 of the finished tungsten carbide component. The overlay 136 may also be made of an industrial diamond material and may include a single coating or outer layer or multiple coating or outer layers of such industrial diamond material, natural diamond, polycrystalline diamond (PCD) material, and polycrystalline diamond composite and/or compact (PDC) material. The single or multiple coatings or layers may be formed by a high pressure, high temperature (HPHT) process. The finished tungsten carbide component, which includes the tip 122 and the base 126, and the overlay 136 on the forward end 134 of the tip 122 are centered and placed in a can or metal enclosure and a plurality of hydraulic pistons apply pressure and force on the can over time during the HPHT process, compressing and/or pressing the tip 122 and base 126 again. The HPHT process liquefies the binder material, such as cobalt in this embodiment, which migrates toward the overlay 136 and binds to the diamond and tungsten carbide producing a stronger form. The diamond to diamond bond in the overlay 136 and tip 122 is created by the catalytic attachment of the cobalt within the small cavities of diamond crystals in the overlay 136.

During the HPHT process, excess PCD material 138 forms a bulge or small flash between a distal end 140 of the tip 122 and the forward end 124 of the base 126. The excess PCD material 138 can be used as formed on tools that are used in milling, trenching, mining, and similar applications. The overlay 136 occupies a large radial and axial profile of the tip 122 which allows faster heat transfer into a region subjacent to the overlay 136 PCD layer. Excessively high heat, such as temperatures above 1300 degrees F., is the greatest cause of PCD failure due to diamond connective failure, the quick heat transfer from the tip 122 of the PCD cutting zone to the subjacent region below the PCD drastically reduces the possibility of a temperature of the tip 122 of the PCD reaching temperatures at or above 1300 degrees F. for any extended period of time thereby avoiding failure of the PCD layer. Furthermore, a tapered base sidewall, such as the tapered outer surface 128 of base 126, on a PDC insert provides a greater concentration of forces applied at the forward PCD overlay 136 and tungsten carbide interface in tip 122 than when using a cylindrical, non-tapered base sidewall and the HPHT process. All external forces 142 are applied at right angles to the tapered outer surface of the tip insert 120, which depends on the vector force directed axially towards the tip 122.

As used in this application, the term "or" is intended to mean an inclusive "or" rather than an exclusive "or". That is, unless specified otherwise, or clear from context, "X includes A or B" is intended to mean any of the natural inclusive permutations. That is, if X includes A; X includes B; or X includes both A and B, then "X includes A or B" is satisfied under any of the foregoing instances. In addition, "X includes at least one of A and B" is intended to mean any of the natural inclusive permutations. That is, if X includes A; X includes B; or X includes both A and B, then "X includes at least one of A and B" is satisfied under any of the foregoing instances. The articles "a" and "an" as used in this application and the appended claims should generally be construed to mean "one or more" unless specified otherwise or clear from context to be directed to a singular form. Moreover, use of the term "an implementation" or "one implementation" throughout is not intended to mean the same embodiment, aspect or implementation unless described as such.

While the present disclosure has been described in connection with certain embodiments and measurements, it is to be understood that the invention is not to be limited to the disclosed embodiments and measurements but, on the contrary, is intended to cover various modifications and equivalent arrangements included within the scope of the appended claims, which scope is to be accorded the broadest interpretation so as to encompass all such modifications and equivalent structures as is permitted under the law.

What is claimed is:

1. A bit tip insert comprising:

a body including a diameter of at least five-eighths inch at a widest part of the body, the body comprising:

a tip including an overlay on an outer surface of the tip, the overlay on the outer surface of the tip formed by a high pressure high temperature (HPHT) process; and a base subjacent the tip, the base including a sidewall inwardly tapered towards a distal end of the base; and an overfill portion formed generally between the tip and the base during the HPHT process, the overfill portion extending outwardly of the widest part of the body.

2. A bit tip insert comprising:

a body including a diameter of at least five-eighths inch at a widest part of the body, the body comprising:

a tip including an overlay on an outer surface of the tip, the overlay on the outer surface of the tip is formed by a high pressure high temperature (HPHT) process; and a base subjacent the tip, the base including a cylindrical sidewall axially extending from the tip; and an overfill portion formed generally between the tip and the base during the HPHT process, the overfill portion extending outwardly of the widest part of the body.

* * * * *